United States Patent [19]

Matsumoto

[11] Patent Number: 4,501,613

[45] Date of Patent: Feb. 26, 1985

[54] WEAR RESISTANT SINTERED BODY

[75] Inventor: Shuji Matsumoto, Yokohama, Japan

[73] Assignee: Tokyo Shibaura Denki Kabushiki Kaisha, Japan

[21] Appl. No.: 513,797

[22] Filed: Jul. 14, 1983

[30] Foreign Application Priority Data

Jul. 22, 1982 [JP] Japan ..... 57-127873
Jul. 22, 1982 [JP] Japan ..... 57-127874

[51] Int. Cl.[3] ..... C22C 39/02

[52] U.S. Cl. ..... 75/240; 75/228; 75/238; 148/16.6; 148/31.5

[58] Field of Search ..... 75/228, 238, 240; 148/31.5, 16.6

[56] References Cited

FOREIGN PATENT DOCUMENTS 2222904 10/1973 Fed. Rep. of Germany .

OTHER PUBLICATIONS

Norm Sint, (Heat Treatment of Metal Parts), 1979 Edition.

*Primary Examiner*—Veronica O'Keefe
*Attorney, Agent, or Firm*—Cushman, Darby & Cushman

[57] ABSTRACT

The invention provides a method for manufacturing a sintered body, which comprises the steps of preparing a green compact comprising 5 to 60% weight of a chromium-containing ferroalloy powder, 0.2 to 2% by weight of a graphite powder, and a balance consisting substantially of an iron powder; sintering the green compact to provide a sintered body; nitriding the sintered body; and treating the nitrided sintered body with steam. The sintered body after nitridation may by subjected to a heat treatment in a non-oxidizing atmosphere before being steam-treated. A wear resistant sintered body manufactured by this method is also provided.

2 Claims, 2 Drawing Figures

WEAR RESISTANT SINTERED BODY

BACKGROUND OF THE INVENTION

The present invention relates to a wear resistant sintered body for use in a blade or the like of a rotary compressor, and to a method for manufacturing the same.

A rotary compressor is used for an air conditioner, a shop window display case or the like and has a structure as shown in FIG. 1. Referring to FIG. 1, a rotor 2 eccentrically rotates within a cylinder 1 and in contact with a blade 3. The blade 3 is constantly urged against the rotating rotor 2 and reciprocates in accordance with the rotation of the rotor 2, thereby partitioning the interior of the cylinder 1. For this purpose, the blade 3 must be air-tight and must also have a high wear resistance. The wear at that portion of the blade 3 which is in contact with the rotor 2 and with the cylinder 1 is generally significant.

Accordingly, most conventional blades of a rotary compressor of the type described above are made of a material with an improved wear resistance, such as high-speed steel or eutectic graphite cast iron. Japanese Patent Publication No. 57-9421 (Published on Feb. 22, 1982) discloses a technique of treating a sintered body of an iron-based powder with steam to give the body improved wear resistance and air-tightness.

Some air conditioners are operated under severe conditions, e.g., in Middle and Near East countries, or with an inverter. Thus, a rotary compressor used in such an air conditioner must operate under severe conditions such as those occurring in high-speed operation or variable-speed operation. The blades of the rotary compressor must also have a higher wear resistance than conventional blades for high-speed operation.

However, a conventional blade consisting of a casting material or a sintered body does not have a high abrasion resistance to withstand use under severe operating conditions, and cannot therefore be used in numerous practical situations.

SUMMARY OF THE INVENTION

It is an object of the present invention to provide a sintered body having a high wear resistance so as to withstand use under severe conditions, in particular, a sintered body for a rotary compressor, and also to provide a method for manufacturing the same.

According to an aspect of the present invention, there is provided an wear resistant sintered body comprising 10 to 30% by weight of chromium, 0.2 to 2% by weight of carbon, and a balance consisting of unavoidable impurities and iron, and wherein a metal carbide and a metal oxide are dispersed in a matrix obtained by tempering martensite, and nitrogen is included in at least the matrix in the form of a solid solution.

According to another aspect of the present invention, there is also provided a method for manufacturing a wear resistant sintered body, comprising the steps of preparing a green compact comprising 5 to 60% by weight of a chromium-containing ferroalloy powder, 0.2 to 2% by weight of a graphite powder, and a balance being substantially iron powder; sintering the green compact to provide a sintered body; nitriding the sintered body; and treating the nitrided sintered body with steam.

The sintered body after nitridation may be heat-treated in a non-oxidizing atmosphere before being steam-treated. In the method of the present invention, the balance constituting one component of the green compact and consisting substantially of an iron powder may be entirely replaced by a ferroalloy powder containing nickel, copper and molybdenum. Alternatively, part of the iron powder or part of the ferroalloy powder may be replaced by a nickel powder.

DETAILED DESCRIPTION OF THE PREFERRED EMBODIMENTS

Figure 1:
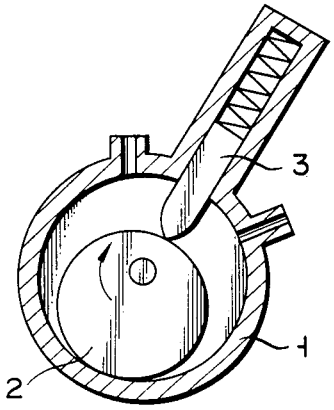
FIG. 1 is a sectional view of a rotary compressor having a blade which may comprise a sintered body according to the present invention.

A method for manufacturing a sintered body according to the present invention will now be described.

A raw material powder is first obtained which consists of a chromium-containing ferroalloy powder, a graphite powder and a balance being substantially an iron powder and preferably consisting of a ferroalloy powder containing nickel, copper and molybdenum. Part of the iron powder or the ferroalloy powder may be replaced by a nickel powder.

Part of the chromium in the chromium-containing ferroalloy powder bonds with graphite in the sintering step so as to disperse the carbide in the sintered body structure. The remaining portion of chromium is included in the matrix in the form of a solid solution to improve a hardening effect. Thus, cooling of the sintered body with air after sintering results in the formation of hard martensite and delays softening of the martensite matrix when tempered by treatment with steam. Upon nitridation, the chromium bonds with nitrogen to improve wear resistance of the sintered body. When the amount of the chromium-containing ferroalloy powder is 5% by weight or less, only a small amount of it bonds with nitrogen to form a hard matrix phase. On the other hand, when the amount of ferroalloy powder exceeds 60% by weight, too much hard matrix phase is formed, resulting in weak bonds between particles and an increased brittleness. Accordingly, the amount of chromium-containing ferroalloy powder must be within the range of 5 to 60% by weight and preferably within the range of 10 to 45% by weight. The chromium-containing ferroalloy powder preferably contains 10 to 30% by weight of chromium, an example of such a powder being a stainless steel powder.

During the sintering step, part of the graphite powder bonds with chromium, forming carbide, dispersed in the texture of the sintered body. The remaining part of the carbon powder is included in the matrix structure in the form of a solid solution and forms martensite in the subsequent cooling step. When the amount of graphite powder is below 0.2% by weight, the desired effect is not obtained. On the other hand, when the amount of carbon powder exceeds 2% by weight, the sintered body becomes too brittle and cannot be properly formed into the green compact. Accordingly, the amount of graphite powder must be within the range of 0.2 to 2% by weight and preferably within the range of 0.6 to 1.5% by weight.

The respective components of an iron-nickel-copper-molybdenum-alloy powder impart strength and toughness to the matrix structure. The amounts of the respective components must be as follows: 0.7 to 5% by weight and preferably 1 to 3% by weight of nickel, 0.7 to 3% by weight and preferably 1 to 2% by weight of copper, and 0.3 to 1% by weight and preferably 0.4 to 0.7% by weight of molybdenum. This alloy powder is included in the matrix structure to provide a proper strength and toughness to the sintered body.

Since the nickel powder is not nitrided during the nitridation treatment, it is utilized for bonding between the particles of the matrix structure. When the amount of nickel powder is below 1% by weight, no effect is obtained from its addition. However, when the amount of nickel powder exceeds 10% by weight, the soft phase increases and the wear resistance is lowered. Accordingly, the amount of nickel powder must be within the range of 1 to 10% by weight and preferably 3 to 8% by weight.

The raw material powder composition thus prepared is compressed at a pressure of 4 to 6 ton/cm$^2$ to obtain a green compact of a predetermined shape. The green compact thus obtained is sintered in a reducing atmosphere at 1,100° to 1,300° C. to provide a sintered body. Upon sintering, an iron nitride and a chromium nitride are formed in a dispersed form in the structure of the sintered body. When such a sintered body is cooled in a later step, martensite is formed.

Thereafter, the sintered body is nitrided to form a nitride phase therein. Nitridation is performed at 500° to 700° C. for 15 minutes to 2 hours in an atmosphere containing 30 to 60% by volume of ammonia. Then, an iron nitride and a chromium nitride are formed in a dispersed form in the matrix structure of the sintered body to impart wear resistance to the sintered body.

The sintered body after nitridation is then treated with steam. This treatment is performed using overheated steam at 0.1 to 2 kg/cm$^2$ and 500° to 650° C. for 1 to 4 hours. Then, an iron oxide is formed, dispersed; it is formed in the open pores of the matrix structure of the sintered body. The iron oxide serves to improve the wear resistance of the sintered body and to seal the open pores of the matrix texture of the sintered body. As a result, the open pores are reduced to 5% or less. The iron oxide also serves to improve lubricant retention performance. When steam treatment is performed, nitrogen in the matrix structure of the sintered body is dispersed and included in the particles in the form of a solid solution. The presence of nitrogen thus significantly makes the sintered body less brittle. Nitrogen (gas) which has entered into the open pores in the matrix structure of the sintered body upon nitridation becomes attached to the particles of the structure to form a nitride. However, although the nitrogen attached to the particles improves hardness of the particles, it impairs the bonding force between particles. Thus, the particles may be separated, resulting in chipping or embrittlement of the sintered body. In order to prevent this, a steam treatment is performed. When the steam treatment is performed, nitrogen attached to the particles is heated and then included in the particles in the form of a solid solution. When nitrogen is dispersed in the matrix structure, the sintered body will have a uniform hardness regardless of the depth of nitridation. Accordingly, embrittlement by nitridation is prevented, and a high wear resistance may be obtained by nitridation.

The sintered body after nitridation may be heat-treated in a non-oxidizing atmosphere before being steam-treated. The heat treatment may be performed in hydrogen or nitrogen at 1,100° to 1,300° C. for 20 minutes to 2 hours. Then, chromium carbide and nitride are formed to improve hardness and wear resistance of the sintered body.

When nickel is added as a powder component of the sintered body, the bonding between particles may be further strengthened.

A sintered body of the present invention thus prepared has a tough matrix structure, an excellent airtightness, and a low brittleness. The sintered body thus has an excellent wear resistance and can thus be used under severe conditions. The sintered body of the present invention may therefore be used for a blade of a rotary compressor, a vane of a vane pump, a rocker arm of an engine or the like.

EXAMPLE 1

A sintered body was prepared according to the following procedures. A raw material powder composition was prepared which consisted of 40% by weight of a ferroalloy powder containing 13% by weight of chromium (SUS 410L powder); 1.5% by weight of a carbon powder; a balance of an iron powder containing 1.8% by weight of nickel, 1.5% by weight of copper, and 0.5% by weight of molybdenum; and 0.7% by weight of zinc stearate as a binder. The resultant raw material powder composition was compressed at a forming pressure of 6 ton/cm$^2$, thus forming a sheet-like green compact having a thickness of 5 cm. The green compact was sintered in a hydrogen atmosphere having a dew point of less than −20° C. at a temperature of 1,200° C., and was then cooled at a rate equivalent to that of air cooling. The sintered body was then nitrided in a mixture of RX gas (CO), ammonia gas, and nitrogen gas at a temperature of 600° C. for 0.5 hours. The sintered body after nitridation was then subjected to a steam treatment using overheated steam at 0.5 kg/cm$^2$ and at 600° C. for 3 hours to obtain a sintered body as Example 1 of the present invention. As a control, a sintered body was obtained following the same procedures as for Example 1 except that nitridation was not performed.

Figure 2:
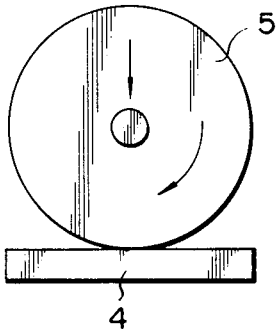
FIG. 2 is a representation for explaining an abrasion resistance test of the sintered body.

In order to compare the wear resistance characteristics of the sintered bodies of Example 1 and the Control, samples 4 were prepared from both sintered bodies as shown in FIG. 2. A rotary disc 5 consisting of eutectic graphite cast iron was rotated at a frequency of 210 rpm and was brought into contact with each sample 4 at a pressure of 25 kg so as to test the wear of the sample 4. A lubricant was applied between each sample 4 and the rotary disc 5. As a result, when the wear of the sample 4 obtained from the sintered body of the Control was defined as 100%, that of Example 1 of the present invention was 60%. Accordingly, the sintered body of the present invention is subject to a very small wear and thus has excellent wear resistance in comparison with a sintered body obtained by a conventional method.

When the sintered body of the present invention was used as a blade of a rotary compressor which was operated under severe conditions, the blade provided an excellent hermetic seal and exhibited only very small abrasion wear.

EXAMPLE 2

A sintered body of the present invention was obtained following the procedures of Example 1 except that the sintered body after nitridation was subjected to a heat treatment at 1,200° C. for 0.5 hours in hydrogen before being subjected to the steam treatment. The sintered body of Example 2 was subjected to an abrasion test by the method shown in FIG. 2 together with the sintered body of the Control prepared in Example 1 above. As a result, when the wear of the sintered body of the Control was defined as 100%, that of the sintered body of Example 2 was 50%.

EXAMPLE 3

A sintered body (Sample Nos. 1 to 5) of the present invention and a sintered body (Sample Nos. 6 and 7) of the Control were prepared following the procedures of Example 1. The presence/absence of nitrogen included in the form of a solid solution in each sintered body was examined using an EPMA (Electron Probe Micro Analyzer). Measurements were made at a voltage of 10 kV and a current of $2\times10^{-7}$ Amp. The radiation area of the sample was 0.1 $mm^2$. The dent made by measurement of the Vickers hardness of the chromium carbide phase was irradiated with X-rays so as to measure NK$\alpha$-rays, thereby confirming the presence/absence of nitrogen. The results are shown in the Table below.

TABLE

| Sample No. | Vickers hardness (mHV) | X-ray dose (cps) |
|---|---|---|
| 1 | 965 | 100 (clear peak) |
| 2 | 739 | 26 (unclear peak) |
| 3 | 739 | 10 (peak present) |
| 4 | 713 | 7 (peak present) |
| 5 | 666 | 21 (clear peak) |
| 6 | 623 | 0 |
| 7 | 557 | 0 |

As may be seen from the Table above, the Vickers hardness of the sintered body (Sample Nos. 1 to 5) of the present invention wherein nitrogen is included in the form of a solid solution is greater than that of the sintered body (Sample Nos. 6 and 7) of the Control wherein nitrogen is not included in such a form. This fact demonstrates the superior properties of the sintered body which is prepared by the method of the present invention in which the sintered body is subjected to nitridation before it is subjected to steam treatment.

What is claimed is:

1. A wear resistant sintered body consisting essentially of 10 to 30% by weight of chromium, 0.2 to 2% by weight of carbon, 1 to 10% by weight of nickel, and a balance consisting of unavoidable impurities and iron, and wherein a metal carbide and a metal oxide are dispersed in a matrix obtained by tempering martensite, and nitrogen is included in at least the matrix in a form of a solid solution.

2. A sintered body according to claim 1, wherein part or all of the balance consists of 0.7 to 5% by weight of nickel, 0.7 to 3% by weight of copper, 0.3 to 1% by weight of molybdenum, and a balance of iron.

* * * * *